United States Patent [19]

Sakai et al.

[11] Patent Number: 4,667,703

[45] Date of Patent: May 26, 1987

[54] APPARATUS FOR MANUFACTURING DOUBLE CONNECTING PILE FABRIC

[75] Inventors: Masaaki Sakai; Seiichi Yamagata, both of Otsu, Japan

[73] Assignee: Toray Industries, Inc., Tokyo, Japan

[21] Appl. No.: 731,166

[22] Filed: May 6, 1985

[30] Foreign Application Priority Data

May 14, 1984 [JP] Japan ..... 59-94544

[51] Int. Cl.[4] ..... D03D 39/16

[52] U.S. Cl. ..... 139/20; 139/21; 28/159

[58] Field of Search ..... 139/21, 22, 20, 23, 139/304; 28/159, 168

[56] References Cited

U.S. PATENT DOCUMENTS

| | | | |
|---|---|---|---|
| 1,524,398 | 1/1925 | Kenney | 139/21 |
| 1,757,555 | 5/1930 | Bachofen | 139/21 |
| 2,142,025 | 12/1938 | Hall | 139/21 |
| 2,285,793 | 6/1942 | Baker | 139/21 |
| 2,732,865 | 1/1956 | Neisler | 139/20 |
| 2,898,665 | 8/1959 | Salem | 28/168 |
| 2,969,580 | 1/1961 | Wyner | 28/168 |
| 3,216,460 | 11/1965 | Tomayko | 139/20 |
| 3,394,739 | 7/1968 | Crenshaw et al. | 139/21 |
| 3,602,964 | 9/1971 | Corrier | 28/168 |
| 3,857,418 | 12/1974 | Kida | 139/20 |
| 3,960,185 | 6/1976 | Bühler | 139/22 |

FOREIGN PATENT DOCUMENTS 180638 10/1983 Japan .

*Primary Examiner*—Werner H. Schroeder
*Assistant Examiner*—Joseph S. Machuga
*Attorney, Agent, or Firm*—Austin R. Miller

[57] ABSTRACT

An improved apparatus for manufacturing a double connecting fabric having an upper ground construction, a lower ground construction, and pile yarns connecting both ground constructions by withdrawing the double connecting fabric by a plurality of spiked rollers arranged at positions downstream of a reed of a double velvet loom and contacting the upper ground construction and the lower ground construction.

5 Claims, 4 Drawing Figures

APPARATUS FOR MANUFACTURING DOUBLE CONNECTING PILE FABRIC

FIELD OF THE INVENTION

The present invention relates to an improvement of a double velvet loom. Also, the present invention relates to an improvement of a method for withdrawing a fabric from a double velvet loom.

DESCRIPTION OF THE RELATED ART

In a conventional double velvet loom for weaving a pile fabric, such as a moquette used for a chair or a wilton carpet, two pile fabrics are simultaneously obtained by inserting connecting yarns between the upper ground construction and lower ground construction, and cutting connecting yarns connecting the constructions by means of a pile cutting knife reciprocally moving in the widthwise direction of the loom between the two constructions. This results in two pile fabrics: an upper pile fabric and a lower pile fabric. The upper pile fabric and the lower pile fabric are separately withdrawn by individual withdrawing forces. In a conventional double velvet loom, it is difficult to withdraw a double connecting fabric without cutting the connecting yarns. In particular, this is impossible with a double connecting fabric using connecting yarns having a length of 10 mm or more. In a conventional double velvet loom, the simultaneous manufacture of two pile fabrics is a characteristic feature. There has been no demand for developing a method for withdrawing a double connecting fabric without separation into two pile fabrics.

Japanese Unexamined Patent Publication (Kokai) No. 58-180638 discloses a technique close to the present invention. In this prior art, separation of connecting yarns is achieved by "slippage", not cutting, of the fibers in the connecting yarns on the double velvet loom. In the case of use of the fabric as artificial fur, this technique does not sufficiently protect the tapered ends of the "guard hair"—an essential element in an artificial fur.

SUMMARY OF THE INVENTION

An object of the present invention is to provide apparatus for manufacturing a double connecting fabric with the upper ground construction and lower ground construction remaining connected with connecting yarns, i.e., withdrawing the double connecting fabric from a weaving portion of a double velvet loom without cutting the connecting yarns.

If connecting yarns including fibers capable of being dissolved and removed are used, it is not necessary to cut the connecting yarns on the double velvet loom. Thus, it is possible to withdraw the double connecting fabric from the loom, dissolve these fibers, and therefore separate the double connecting fabric without damage to the tapered ends of the raising hairs in the connecting yarns.

The above-mentioned object of the present invention can be obtained by a method for manufacturing a double connecting fabric, by forming an upper ground construction and a lower ground construction and simultaneously connecting pile yarns between the constructions, wherein the double connecting fabric is withdrawn from a loom continuously weaving the fabric, without separation of the double connecting fabric, by application of a withdrawing force to the upper ground construction and the lower ground construction.

An apparatus for performing the above method according to the present invention includes a weaving device, for forming an upper ground construction and a lower ground construction and simultaneously connecting yarns between the constructions, and at least one spiked roller for each ground construction. The spiked rollers are arranged at a position downstream of a reed of the weaving device, contact the respective ground constructions, and are capable of rotating in the same direction as the direction of advancing of the fabric.

DESCRIPTION OF THE PREFERRED EMBODIMENTS

The present invention will be described in detail in accordance with the attached drawings illustrating embodiment of the present invention.

Figure 1:
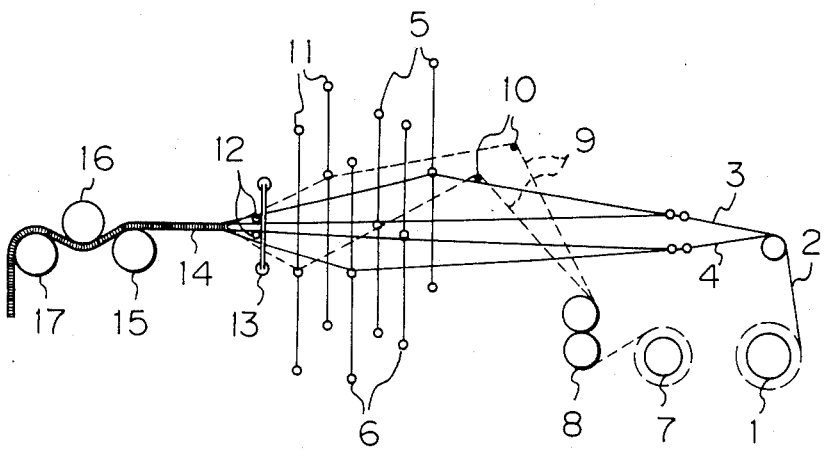
FIG. 1 is a schematic side view of a double velvet loom according to the present invention.

FIG. 1 is a side view of a double velvet loom according to the present invention. As shown in FIG. 1, a plurality of ground warp yarns 2 fed from a ground warp yarn beam 1 are divided in upper ground warp yarns 3 and lower ground warp yarns 4. A shedding motion is applied to the upper ground warp yarns 3 by upper ground heddles 5, and a sheddding motion is applied to the lower ground warp yarns 4 by lower ground heddles 6. Connecting yarns 9 fed through a yarn feeding roll 8 from a connecting yarn beam 7 are run through a connecting yarn tension adjusting device 10 to connecting yarn heddles 11. A shedding motion is applied to the connecting yarns 9 by the connecting yarn heddles 11. A double connecting fabric 14 is obtained by controlling the shedding motion of the upper and lower ground warp yarns and the connecting yarns, the picking motion of weft yarns 12, and the beating motion of reeds 13 to predetermined conditions corresponding to the weaving pattern of the desired double connecting fabric.

The above motions are repeated for continuous weaving of the double connecting fabric. The fabric can be withdrawn as a single body consisting of the upper ground construction, the lower ground construction, and the connecting yarns by means of three spiked rollers 15, 16, 17 having a plurality of needles on their circumferential surface and rotated at the same circumferential speeds. In this case, the lower ground construction is subjected to a withdrawing force by the first spiked roller 15 and the third spiked roller 17, and the upper ground construction is subjected to a withdrawing force by the second spiked roller 16.

The relative positions between the three spiked rollers 15, 16, 17 and the thickness and density of the needles set on the circumferential surface of the spiked rollers must be such that a withdrawing force larger than the maximum tension applied to the ground warp yarn at the time of weaving is applied to the upper and lower ground constructions.

When the double connecting fabric is withdrawn under the state shown in FIG. 2, the withdrawing force F and the other factors as described hereinafter are preferably determined such that the following equation is satisfied:

$$F = f\frac{2\pi r \cdot a}{360} b \cdot d > mt_1 + nt_2$$

where

"f" stands for the force which a needle can withstand, i.e., a shearing force and a bending force in the tangential direction of the roller (kg per needle), "d" stands for the density of needles (number per $cm^2$), "r" stands for the radius of the spiked rollers, "a" stands for the contact angle between the spiked rollers and the ground construction, "b" stands for the contact width between the spiked rollers and the ground construction (cm), "$t_1$" stands for the horizontal component of tension per ground warp yarn (kg per yarn), "$t_2$" stands for the horizontal component of tension per connecting yarn (kg per yarn), "m" stands for the total number of ground warp yarns, and "n" stands for the total number of connecting yarns.

It is preferable that the length of the needles on the spiked rollers be such that the needles can stick into only one ground construction. If the needles can stick through both ground constructions, both the upper ground construction and the lower ground construction would be withdrawn on a circumferential surface of one spiked roller, resulting in a difference of the withdrawing speed between the upper ground construction and the lower ground construction. This would cause several problems, for example, abnormal tension of the warp yarns and abnormal picking density of the weft yarns, making weaving impossible; occurrence of stretched portions and relaxed portions in the ground construction between the spiked rollers and breakage of the ground weft yarns by the needles of the spiked rollers; and wrinkles on the ground construction.

Several kinds of withdrawing rollers, for example, rollers with a card clothing or a garnett wire or rollers having frictional force can be used to perform the method according to the present invention. However the surfaces of the withdrawing rollers must be capable of applying sufficient withdrawing force to the double connecting fabric.

Figure 2:
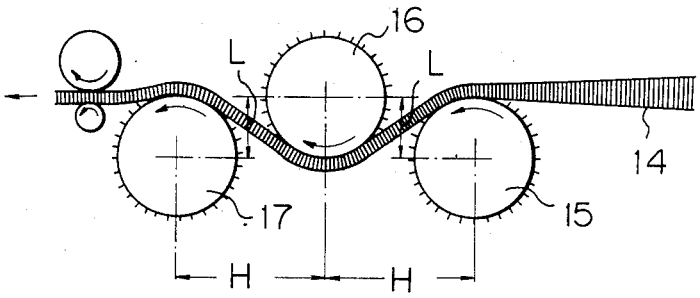
FIG. 2 is a schematic side view of an embodiment of a withdrawing portion of the double velvet loom according to the present invention.
Figure 3:
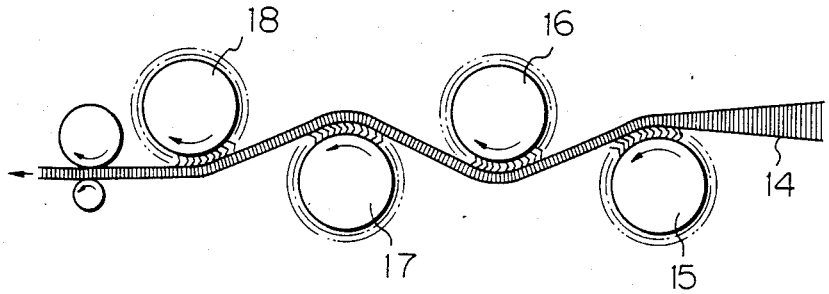
FIG. 3 is a schematic side view of another embodiment of the withdrawing portion of the double velvet loom according to the present invention.

In the present invention, three spiked rollers may be used as shown in FIG. 2 or four spiked rollers may be used as shown in FIG. 3. Though the object of the present invention can be accomplished by using as few as two spiked rollers, it is preferable to use three or four spiked rollers.

Further it is preferable that the relations between the diameter D of the spiked rollers 15, 16 and 17, the distance L in the vertical direction between centers of the each spiked roller, and the distance H in the horizontal direction between centers of the each spiked roller be determined such that the following equations are satisfied $$\tfrac{1}{4}D < L < \tfrac{1}{2}D$$

$$D < H < 1.5D$$

wherein the above parameters are determined in the range satisfying the above described equation $$F = f \cdot \frac{2\pi r \cdot a}{360} \cdot b \cdot d > mt_1 + nt_2.$$

It is preferable in general to use spiked rollers 15, 16 and 17 having a diameter of 10 cm, in accordance with the experience of the inventors. Therefore, it is preferable that the length L be from 2.5 cm to 6.0 cm and the length H be from 10 cm to 18 cm.

Figure 4:
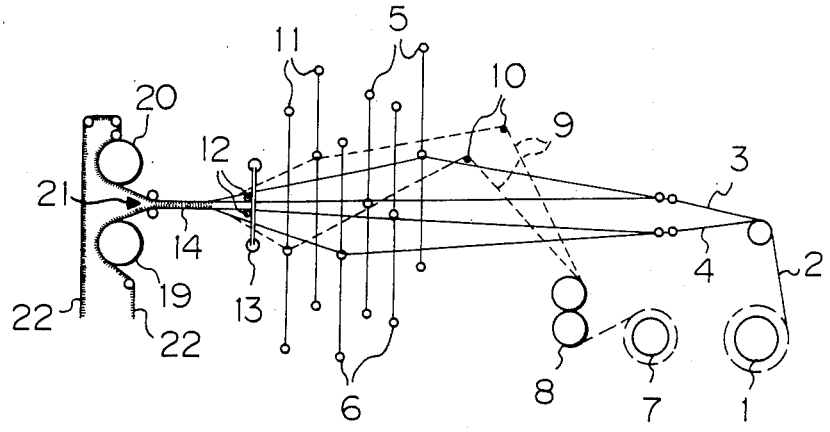
Fig. 4 PRIOR ART
FIG. 4 is a schematic side view of a conventional double velvet loom.

FIG. 4 is a side view of a conventional double velvet loom. As shown in FIG. 4, the portion where the double connecting pile fabric 14 is woven from yarns 3, 4, 9 is identical to the corresponding portion of the double velvet loom according to the present invention. However, the conventional double velvet loom differs from the double velvet loom according to the present invention in the method for withdrawing the double connecting pile fabric 14. That is, in the conventional loom, two withdrawing rollers 19, 20 withdraw the upper ground construction and the lower ground construction separately, with a knife 21 cutting the connecting yarns 9 to obtain the two pile fabrics 22, 22.

If a composite yarn in which a fiber bundle including tapered fibers is wound around by a readily water-soluble filament, such as a polyvinyl alcohol filament, is used as the connecting yarn of the double connecting fabric, the double connecting fabric can be easily separated into two fabrics after withdrawal from the loom by treating the double connecting fabric with hot water.

To clarify the characteristic feature of the present invention, an explanation will be given of examples of the double connecting fabric and the method of producing the same according to the present invention.

EXAMPLE 1

A polyester spun yarn of 30/2 Ne is used as the upper and lower ground warp yarns and the ground weft yarn. A yarn, of 20/2 Ne, in which a blended yarn, comprising polybutylene terephthalate tapered fibers having a fiber length of 20 mm and acrylic bulky fibers having a length of 10 mm, is wound around by a polyvinyl alcohol filament, is used as the connecting yarn. A double connecting fabric is woven with the above mentioned warp yarns and weft yarn under the following conditions by a double velvet loom having constitution illustrated in FIGS. 1 and 2 at a speed of 120 rpm to obtain a single fabric consisting of the ground constructions with the connecting yarns.

- Length of connecting yarn between the upper ground construction and the lower ground construction: 15 mm
- Warp density of each ground construction: 44 ends/inch
- Warp density of each connecting yarn: 44 ends/inch
- Weft density of each ground construction: 36 ends/inch
- Diameter of each spiked roller: 11.6 cm
- Length L illustrated in FIG. 2: 10.0 cm
- Length H illustrated in FIG. 2: 13.0 cm
- Pile fixing construction: fast pile system such as one float over one weft in ground construction and 12 floats as piles.

The polyvinyl alcohol filament is dissolved by treating the obtained double connecting fabric with hot water. An excellent raw fabric for an artificial fur can be obtained.

EXAMPLE 2

A polyester multifilament of 150 denier, 48 filaments is used as the upper ground warp yarn and the lower ground warp yarn. A polyester spun yarn of 30 Ne is used as the ground weft yarn. A yarn of 18 Ne, in which a blended fiber bundle, comprising 40% of polybutylene terephthalate tapered fibers having a fiber length of 28 mm and 60% of polyester tapered fibers having a fiber length of 20 mm and drafted in a roving process of a conventional spinning process, is wound around by a polyvinyl alcohol filament of 56 denier in a spinning process using a covering spinning machine is used as the connecting yarn. A double connecting fabric is woven with the above-mentioned warp yarns and weft yarn under the following conditions by a double velvet loom having the constitution illustrated in FIGS. 1 and 2.

Length of connecting yarn between the upper ground construction and the lower ground construction: 28 mm Warp density of each ground construction: 88 ends/inch Warp density of each connecting yarn: 88 ends/inch Weft density of each ground construction: 56 ends/inch Diameter of each spiked roller: 11.6 cm Length L illustrated in FIG. 2: 10.0 cm Length H illustrated in FIG. 2: 13.0 cm Pile fixing construction: fast pile system such as one float over one weft in ground construction and 16 floats as piles.

When the above-mentioned double connecting fabric is woven at a speed of 100 rpm, the double connecting fabric in which the upper and the lower ground constructions are excellently connected with the connecting yarns to make the same one body is easily obtained.

An excellent artificial fur having raised tapered fibers in a surface of the same can be obtained by dissolving the polyvinyl alcohol filament by treating the obtained double connecting fabric with hot water, by separating the double connecting fabric to two pile fabrics, i.e., an upper pile fabric and a lower pile fabric, by treating a back side of each pile fabric with suitable backing material, and by finishing a raised hair in a surface of the each pile fabric.

As hereinbefore explained in detail, the method and apparatus according to the present invention enable continuous obtainment of a double connecting fabric from a loom. Further, in operating the double velvet loom, the excess load caused by movement of a pile cutting knife can be eliminated. Thus, smoother operation of the double velvet loom can be obtained.

Even if a yarn including a synthetic fiber, e.g. polyester fiber, having a length of about 20 mm and tapered ends for constituting guard hairs in an artificial fur is used as a connecting yarn, the fabric can be produced without damage to the tapered ends of the guard hairs.

We claim:

1. An apparatus for manufacturing a double connecting fabric having parallel layers consisting of an upper ground construction and a lower ground construction and connecting yarns extending therebetween and simultaneously connecting said ground constructions, comprising:

(a) a weaving zone for weaving said double connecting fabric;

(b) a withdrawing zone including means for withdrawing said woven double connecting fabric in a substantially straight line form from said weaving zone after the weaving operation has been completed;

(c) a withdrawing force applying zone following said weaving zone where a withdrawing force is applied to said double connecting fabric in such a way that at least one spiked roller means engages a surface of one of said ground constructions of said double connecting fabric and at least one other spiked roller means engages a surface of the other ground construction, and wherein both said spiked roller means rotate in the same direction as the direction of advance of said fabric and at substantially the same circumferential speed, said one spiked roller means being offset from the other spiked roller means, thereby maintaining said fabric in zig-zag form during the time when said fabric is subjected to the withdrawing forces among said roller means; and (d) a take-up zone wherein said fabric is taken up with a take-up means following said withdrawing force applying zone without separating said ground constructions from each other and without cutting said connecting yarns.

2. An apparatus for manufacturing a double connecting fabric according to claim 1, characterized in that one spiked roller is provided to engage said upper ground construction and two spiked rollers are provided for said lower ground construction.

3. An apparatus for manufacturing a double connecting fabric according to claim 1, characterized in that one spiked roller is provided to engage said lower ground construction and two spiked rollers are provided to engage said upper ground construction.

4. An apparatus for manufacturing a double connecting fabric having parallel layers, comprising a weaving device for forming an upper ground construction and a lower ground construction and simultaneously connecting yarns between said ground constructions, and one spiked roller provided to engage said upper ground construction and two spiked rollers provided to engage said lower ground construction, said rollers being arranged at positions downstream of a reed of said weaving device, said spiked rollers engaging the respective ground constructions and rotating in the same direction as the direction of advance of said fabric and at substantially the same circumferential speed, said three spiked rollers being arranged such that said fabric advances in a zig-zag configuration.

5. An apparatus for manufacturing a double connecting fabric having parallel layers, comprising a weaving device for forming an upper ground construction and a lower ground construction and simultaneously connecting yarns between said ground constructions, and one spiked roller provided to engage said lower ground construction and two spiked rollers provided to engage said upper ground construction, said rollers being arranged at positions downstream of a reed of said weaving device, said spiked rollers engaging the respective ground constructions and rotating in the same direction as the direction of advance of said fabric and at substantially the same circumferential speed, said three spiked rollers being arranged such that said fabric advances in a zig-zag configuration.

* * * * *

UNITED STATES PATENT AND TRADEMARK OFFICE

CERTIFICATE OF CORRECTION

PATENT NO. : 4,667,703

DATED : 5/26/87

INVENTOR(S) : Masaaki Sakai; Seiichi Yamagata

It is certified that error appears in the above-identified patent and that said Letters Patent is hereby corrected as shown below:

Column 6, line 31, delete "for" and insert --to engage--.

Signed and Sealed this

Seventeenth Day of November, 1987

*Attest:*

DONALD J. QUIGG

*Attesting Officer*

*Commissioner of Patents and Trademarks*